US008726431B2

(12) United States Patent
Sverdlik et al.

(10) Patent No.: US 8,726,431 B2
(45) Date of Patent: May 20, 2014

(54) PATIENT REPOSITIONING SYSTEM AND METHOD OF MOVING A PATIENT BODY OR LIMB

(76) Inventors: David Sverdlik, Bufflao Grove, IL (US); Alla Sverdlik, Oak Park, IL (US)

( * ) Notice: Subject to any disclaimer, the term of this patent is extended or adjusted under 35 U.S.C. 154(b) by 0 days.

(21) Appl. No.: 13/534,659

(22) Filed: Jun. 27, 2012

(65) Prior Publication Data

US 2014/0000023 A1 Jan. 2, 2014

(51) Int. Cl.
*A61G 7/14* (2006.01)

(52) U.S. Cl.
USPC ..... 5/83.1; 5/85.1; 5/88.1; 5/81.1 T

(58) Field of Classification Search
USPC ..... 5/81.1, 86.1, 83.1, 84.1, 85.1, 87.1, 5/88.1, 89.1
See application file for complete search history.

(56) References Cited

U.S. PATENT DOCUMENTS 2,603,851 A 7/1952 Hawkins
4,446,587 A * 5/1984 Jump ..... 5/83.1
4,887,325 A * 12/1989 Tesch ..... 5/84.1
5,036,557 A * 8/1991 Fales ..... 5/81.1 R
5,539,941 A * 7/1996 Fuller ..... 5/85.1
5,608,929 A * 3/1997 Crane ..... 5/81.1 R
5,673,443 A 10/1997 Marmor
6,321,398 B1 * 11/2001 Wang ..... 5/81.1 R
2008/0301873 A1 * 12/2008 White et al. ..... 5/85.1

FOREIGN PATENT DOCUMENTS

FR 2866559 A1 8/2005
GB 191012198 A 0/1911

OTHER PUBLICATIONS

International Search Report for International application No. PCT/US2013/048166, dated Oct. 16, 2013.
Written Opinion for International application No. PCT/US2013/048166, dated Oct. 16, 2013.

* cited by examiner

*Primary Examiner* — William Kelleher
*Assistant Examiner* — David R Hare
(74) *Attorney, Agent, or Firm* — Marshall, Gerstein & Borun LLP

(57) ABSTRACT

A patient repositioning system to move and fix a patient body and/or a limb of a patient body in any sequence of multiple operations with positive body or limb support at any angle of rotation or repositioning.

17 Claims, 9 Drawing Sheets

PATIENT REPOSITIONING SYSTEM AND METHOD OF MOVING A PATIENT BODY OR LIMB

BACKGROUND OF THE INVENTION

1. Field of Invention

The invention relates generally to systems for moving a patient on a surface, such as a bed or gurney; for lateral transfer a patient from one surface to another surface and rotation of the patient and/or limbs at any angle. The invention specifically relates to systems where a patient body or a limb can be moved and fixed in any sequence of multiple operations with a single drive and where the patient body and/or limb has positive support at any angle of rotation.

2. Description of Related Technology

Patient movement and repositioning occurs on a regular basis in hospitals and in other medical care facilities, such as nursing homes or home care. There are a variety of devices dedicated to patient repositioning. However, the known patient moving devices cannot perform multiple operations of patient repositioning with a single drive and at the same time provide positive support of the patient body at any angle of rotation.

Existing patient repositioning systems with a single drive can provide only a single function of patient repositioning, e.g., lateral transfer or rotation, with support of the patient body only at angles of less than 90°. Some movements can combine rotation and limb lifting, but the rotation and limb lifting are combined in a single operation. In such devices, only the first movement is controllable and the second movement is tied to the first movement. U.S. Pat. No. 6,615,423, and U.S. Pat. No. 6,629,323, which are hereby incorporated by reference herein, discloses examples of such devices. When used to perform multiple patient movements, e.g., lateral transfer or rotation, these existing systems, require more than one system.

When rotating a patient from 0° to 180°, e.g., a prone operation, existing devices provide body support only during rotation from 0° to 90° and the patient body must be additionally supported from free fall in rotation over 90 degrees.

Some mechanisms have been developed for complete 180° rotation, but these mechanisms are bulky and expensive. In one example, U.S. Patent Publication No. 2004/0168253, which is hereby incorporated by reference herein, discloses a device for rotating a patient. This device has controllable movement only to rotate patient up to 90°; movement over 90° is a free fall and the patient is not supported beyond 90° of rotation.

In another example, U.S. Patent Publication No. 2005/0044629, which is hereby incorporated by reference herein, discloses a device for 180° rotation and supports the patient during rotation, but this device is very complicated and expensive.

Moreover, the devices disclosed in U.S. Patent Publication Nos. 2004/0168253 and 2005/0044629 are not capable of performing lateral transfer of a patient from one surface to another and fix the patient body or limb in a suspended position in a multifunctional operation.

SUMMARY

A patient repositioning system moves and fixes a patient body and/or a limb in any sequence of multiple operations with positive body or limb support at any angle of rotation or elevation.

DETAILED DESCRIPTION

Figure 1:
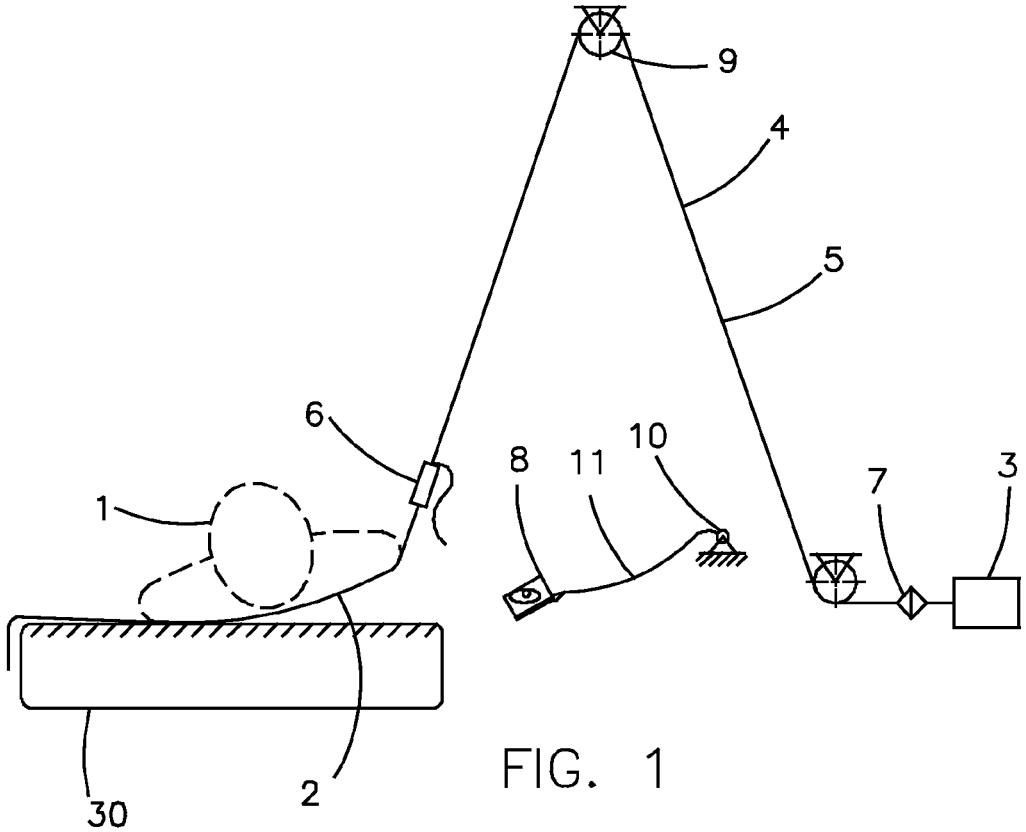
FIGS. 1, 2 and 3 are a schematic illustrations of a patient repositioning system, where patient body or limb can be moved and fixed in any sequence of multiple operations.

Embodiments of the present invention generally relate to systems, machines, products, and methods of moving or rotating a patient body and/or a limb and more specifically to systems, products, and methods of moving or rotating a patient body and/or a limb in any sequence of multiple operations with positive body or limb support at any angle of rotation or elevation.

Certain terms used in the specification are defined below.

The term "patient body" or "limb," as used herein, relates to any part of a body of a patient that is moved or movable by the patient repositioning system The term "transfer surface," as used herein, relates to any surface capable of supporting a patient body or a limb, the term "transfer surface" includes, but is not limited to, a top of a bed, a gurney or any surface where patient is supported and can be transferred or repositioned.

The term "prone operation," as used herein, relates to rotating a patient from 0° to 180 degrees on a surface.

The term "patient support" as used herein, relates to any device that may be used to support a patient body or a limb. The term "patient support" includes, but is not limited to, a sheet, a sling, a patient garment, or any other means for supporting a patient that can be engage with a pulling system of a patient repositioning system. More than one patient support may be combined, e.g., a sheet and a sling, or a sheet and a quantity of the slings, which can be used in multifunctional patient repositioning.

The term "sling" as used herein, refers to strap, a band, or the like, that forms a loop by which a patient body or limb may be supported, suspended, or carried.

The "lateral patient support" as used herein includes any means supporting patient in lateral movement or rotation on angle less than 90 degrees.

The term "frame" as used herein, includes any structure capable of holding components of the patient repositioning system. The term "frame" includes, but is not limited to, stationary or mobile structures, walls, floors, ceilings, beds, gurneys, etc. or any combination of the aforementioned structures such as a bed and ceiling.

The term "drive system," as used herein, refers to any device or system that is capable of imparting pulling force to reposition the patient body or limb. The "drive system" may be a combination of a source of pulling force-drive and a drive connecting system.

The term "drive connecting system," as used herein, relates to any means of connecting a drive system to another element, such as a pulling system. The term "drive connecting system" includes, but is not limited to, a system that operatively connects single or multiple pulling systems by coupling to the drive system in any sequence or combination.

The term "pulling system," as used herein, refers to a chain of components that transfers pulling force and motion from the drive system to the patient support. The term "pulling system" includes, but not limited to, a pulling link operatively connected to a gripper on one end and to a coupling on another end.

The term "coupling," as used herein, refers to any device capable of operatively connecting a pulling link to the drive system. The term "coupling" includes, but is not limited to, any type of connection to a drive directly or to the drive connecting system.

The term "clamp," as used herein, refers to virtually any device capable of holding the pulling system in fixed position under the patient weight.

The term "guiding element" or "guide," as used herein, refers to any means of supporting and guiding pulling links to move a patient in an intended direction.

The term "gripper" or "gripper system," as used herein, refers to any component or combination of the components that are capable of holding or grasping a patient support on one end and on the other end being capable of being connected to the pulling link via a permanent or removable connection.

The term "trapeze," as used herein, refers to a structure that supports at least one guiding element above the transfer surface.

The term "extra support," as used herein, refers to a bar reinforcing trapeze stability.

The term "sliding board," as used herein, refers to plates that support a patient during transfer over a gap between transfer surfaces.

Figure 2:
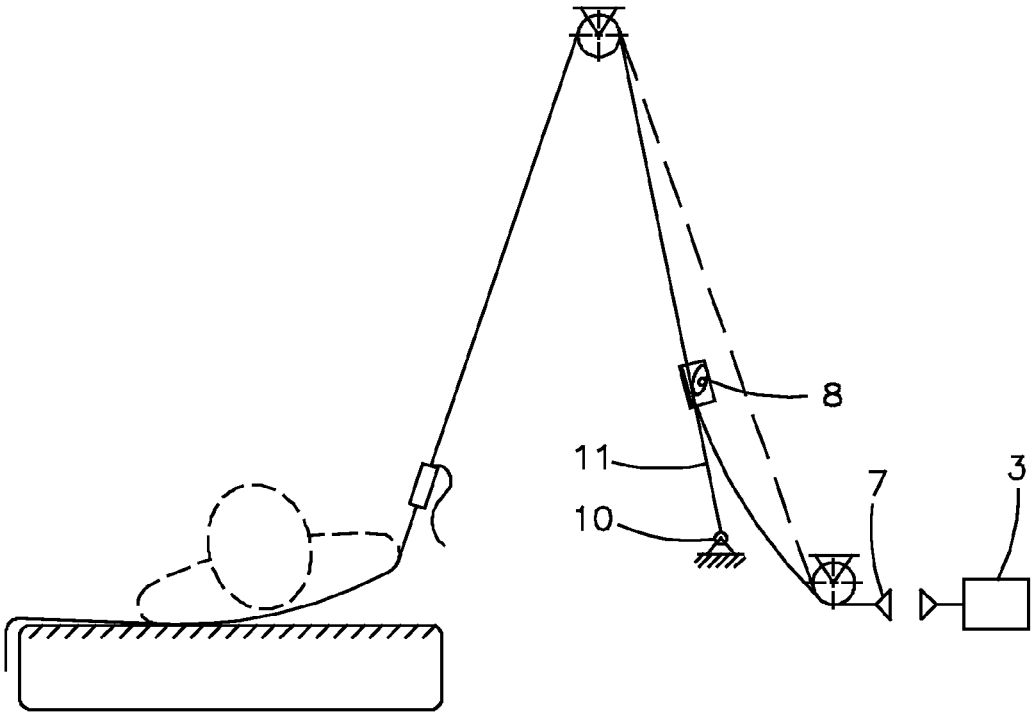
Figure 3:
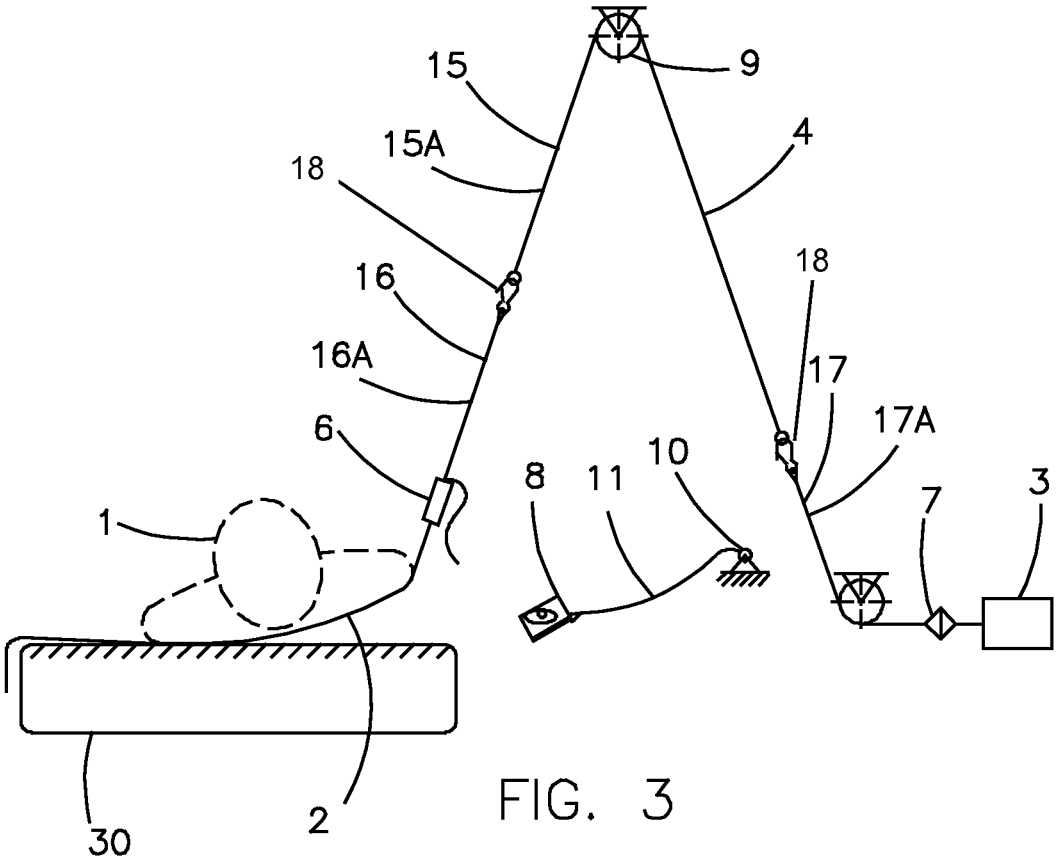

The invention will be described with reference to the following detailed description of several preferred embodiments and to the drawings, wherein like reference numerals are used to represent like elements, and in which:

FIGS. 1-3 are schematic illustrations of one embodiment of a patient repositioning system, where a patient body or a limb 1 can be moved and fixed in any sequence of multiple operations with one drive system 3. Major components of the patient repositioning system are illustrated relative to one another and during operation.

The patient repositioning system includes the drive system 3, a clamp 8, and a guide system 9 attached to a frame 10. A pulling system 4 is supported by the guide system 9 and the pulling system 4 is engaged with a patient support 2 by a gripper 6 and to the drive system 3 by a coupling 7.

A pulling link 5, which is part of the pulling system 4, is engaged with the patient support 2 via the gripper 6 and engaged with the drive system 3 via the coupling 7. When the drive system 3 is activated, the drive system 3 pulls the pulling system 4, which results in movement of the patient body 1 from a first to a second position. The patient support 2, the pulling link 5, the coupling 7, and the drive system 3 are all under tension when supporting a weight of the patient body 1 in a suspended position, as illustrated in FIG. 1.

When the clamp 8 is attached to the pulling link 5, and the drive system 3 is operated in reverse, or opposite to pulling direction, tension in the pulling link 5 from supporting the weight of the patient body 1 is transferred through the clamp 8 to the frame 10 and tension on the pulling link 5 is released between the clamp 8 and the drive system 3. The clamp 8 holds and fixes the patient body 1 in position. When the pulling link 5 is free of tension between the clamp 8 and the drive system 3, the coupling 7 may be disconnected from the drive system 3, as illustrated in FIG. 2.

Once disconnected from the drive system 3, other pulling systems may be engaged with the drive system 3 via the coupling 7 to perform subsequent independent patient repositioning operations.

FIGS. 1-3 illustrate an operation of only one of a plurality of pulling lines of the patient repositioning system.

FIGS. 1-3 illustrate only two embodiments and operations of the invention. The description of these concepts and embodiments should in no way be considered limiting of the broad scope of the invention set forth in the claims. A variety of different systems can be built by those skilled in the art based on the concepts disclosed herein.

The pulling system 4 may include chain of components that transfer pulling force and motion from the drive system 3 to the patient support 2.

FIG. 1 illustrates the pulling system 4 as a single link 5 operatively connected to the gripper 6 and to the coupling 7.

Figure 5:
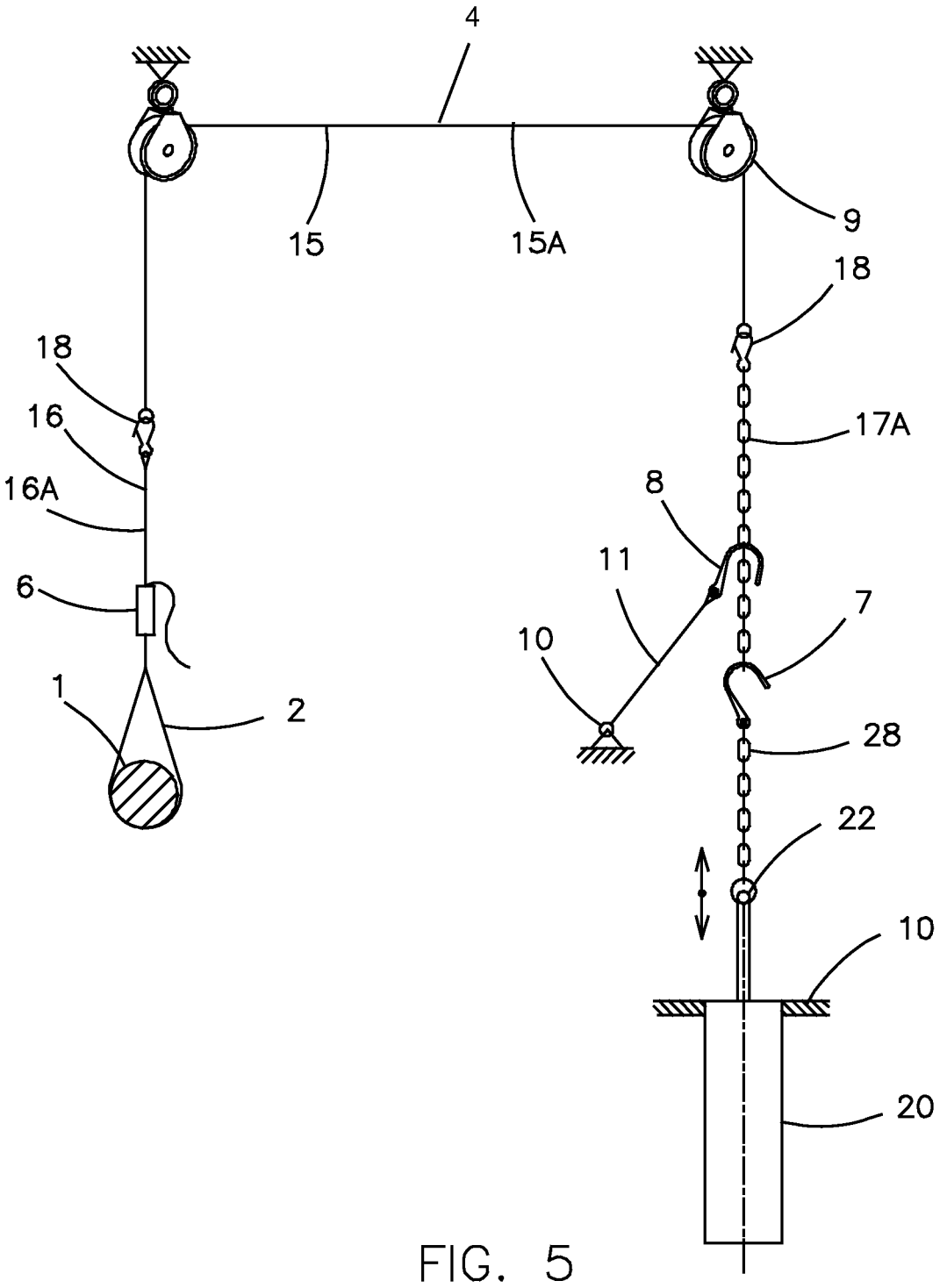
Figure 11:
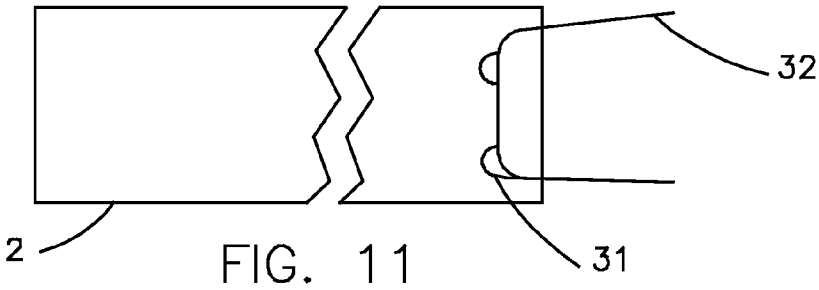
FIG. 11 is an illustration of a patient support for lateral movement.

FIGS. 3, 5, and 11, illustrate the pulling system 4 as a combination of several pulling link sections 15, 16, 17 operatively joined to one another. The pulling link section 15 includes a first link 15*a*, with connections 18 on respective ends to be engaged with pulling link sections 16 and 17. Pulling link section 16 includes a second link 16*a* with gripper 6 attached to the patient support 2 and cooperating with connection 18 to engage the pulling link section 15. Pulling link section 17 includes a third link 17*a* operatively engaged with the coupling 7 and cooperating with connection 18 to be engaged with the pulling link section 15

The first pulling link 15*a* may be supported by the guide 9.

The particular type of the connection 18, the gripper 6, the coupling 7, quick disconnects, engagement with the guides 9, clamp 8, or drive system 3 may determine the type of pulling link 15*a*, 16*a*, 17*a*, which will be used in each pulling link section 15, 16, 17.

In some embodiments, the pulling links 15*a*, 16*a*, 17*a*, may take the form of a cable, a belt, a chain, or other devices and each of the pulling links 15*a*, 16*a*, 17*a* may be made from a different material.

Ends of the pulling links 15*a*, 16*a*, 17*a* may be permanently, removably, or operatively connected to one or more of the gripper 6, the coupling 7, the connections 18, by quick release connections.

By changing a location at which the pulling link 15*a*, 16*a*, 17*a*, is attached to the gripper 8 or to the coupling 7, an overall length of the pulling system 4 engaged with the patient support 2 and drive system 3 may be adjusted. This adjustment is important when more than one pulling system 4 is used for patient movement. Adjustments may be done at any convenient portion of the pulling system 4.

FIG. 5 illustrates one example of a link combination where the pulling link 17*a* is a chain, the pulling link 15*a* is a cable, and the pulling link 16*a* is a belt.

Different combinations of the pulling link sections 15, 16, 17 result in great flexibility to build simple, compact, flexible and economical patient repositioning systems.

FIGS. 2, 3 and 5 illustrate a clamping device 8 where first end is a clamp that can be temporary attached to the pulling link 17*a*, or to any part of the pulling system 4, and a second end attached to the frame 10 via a flexible element 11. In other embodiments the clamp 8 may be attached directly to the frame 10. The clamp 8 may have different designs depending on the type of the pulling link 17 or types of other parts of the pulling system 4 to which clamp 8 will be attached. For example, if the pulling link is a chain 17*a*, the clamp 8 may take the form of a hook. For example, as illustrated in FIG. 5, the clamp 8 may take the form of a simple hook that is adapted to be engaged with the chain 17*a*, or if pulling link 17*a* is a belt, the clamp 8 may take the form of a cam or other locking device. The number of the clamps 8 needed on the system is equal to the number of pulling links simultaneously supporting patient body 1 and/or limb in a suspended, or partially suspended, position. The clamp 8 may be permanently or removably attached to the frame 10.

Figure 4:
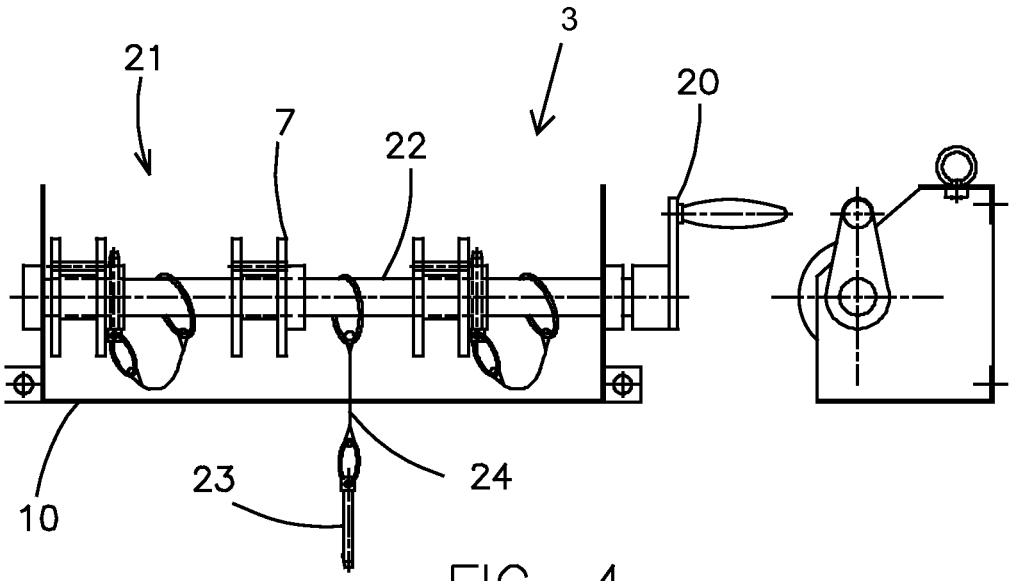
FIGS. 4 and 5 are illustrations of an embodiment of a drive system.

FIGS. 4 and 5 illustrate operative connections of the pulling system 4 to the drive system 3 via the coupling 7. The drive system 3 includes a drive connecting system 21 operatively engaged with a drive 20 and mounted on the frame 10. The drive connecting system 21 is a system to operatively engage single or multiple pulling systems 4 to the source of power or drive 20 via one or more couplings 7, in any sequence or combination. The coupling 7 may have one end operatively capable of being connected to the pulling link 5 and second end operatively engageable with the drive connecting system 21 or in some embodiments to the drive 20 directly.

In FIG. 4, the drive system 3 comprises a rotary type drive 20 connected to a shaft 22 as a part of the drive connecting system 21 and mounted on the frame 10. The coupling 7 is freely positioned on the shaft 22 and operatively connected to shaft 22 via a pin 23 through matching holes. The pin 23 is attached to the shaft 22 via a flexible cable 24. In this embodiment, the pulling link 5 is a flat belt and the coupling 7 is a pulley adapted to be operatively engaged with the pulling link 5 and with the drive shaft 22.

In embodiments of FIG. 5, where the source of power 20 is a linear drive and the pulling link 17*a* is a chain, the coupling 7 may take the form of a hook freely positioned on the shaft 22. The coupling 7 may be attached to the shaft 22 via a flexible element 28. A position of the coupling 7 on the flexible element 28 may be adjustable, which may be beneficial in connections having different length links. The flexible element 28 may be a chain, a cable, or a belt, for example.

In yet other embodiments the coupling 7 may be a human hand holding the pulling link 5.

In a rotary type drive, where pulling link 5 is a chain, the coupling 7 may be a sprocket engaged and freely positioned on the drive shaft 22. By shifting a position of the sprocket 7, the sprocket 7 may be engaged with different pulling links 5 in any sequence of the operation. As a result, a minimum quantity of sprockets 7 needed and can be equal to the maximum quantity of the maximum pulling system 4 that will be simultaneously used for operation.

In some embodiments the coupling 7 may be a pulley permanently attached to the rotary drive. To perform multifunctional operations with a pulley permanently attached to the rotary drive, the patient is first fixed in suspended position with the clamp 8. The drive system 3 unwinds a belt from the pulley 7 to extend a length of belt that is longer than the total distance to move the patient body or limb 1 in all remaining operations. The pulling link 5, the coupling 7, and the drive system 3 are then free of tension. A second pulling link 5 may be attached to a second patient support 2 via another gripper 6. The gripper 6 may be operatively connected to the second link 5 and positioned on the second link 5 to have a minimum stroke distance for a second patient body or limb 1 movement. This embodiment may be effective if a minimum quantity of reposition operations is needed.

The drive system 3 has the ability to be locked, supporting a weight of the patient body or limb in a suspended position. The drive system 3 may have the ability to be locked in position to support the patient body or limb 1 in a desired position before engagement the clamp 8 to the link 5.

To produce the ability of the drive system 3 to independently connect to different pulling systems 4 in any sequence of operations, the patient movement and repositioning system includes the capacity to pre-set engagement of the one or more pulling systems 4 with the patient support 2, the drive system 3, and/or the clamps 8. Activation of the pre-set engagement can be manual or powered. This future can save time in multifunctional operations or can allow an operator to remain protected during an x-ray procedure, while repositioning the patient body or limb 1.

FIGS. 6-9 illustrate a prone operation rotation of the patient body 1 from 0 to 180 degrees, while providing support at all angles of rotation. Support of the patient body 1 is provided by positioning the patient body 1 in a sling 25 forming two plies 26, 27 around the patient body 1 on the side opposite to intended rotation direction. Pulling force is applied to a joint of the two plies 26, 27 to rotate the patient body 1 and to continuously support the weight of the patient body 1 in a suspended position during 0 to 180 degree of rotation.

Figure 6:
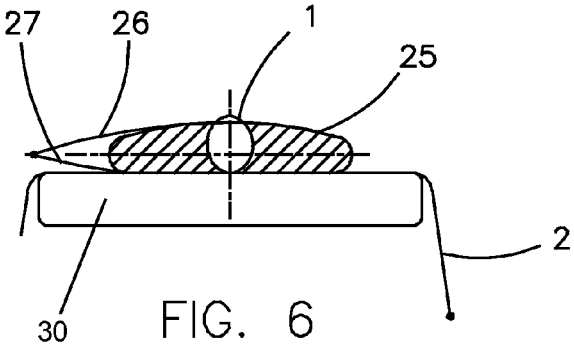
FIGS. 6-9 are schematic illustrations of a prone process operation with the patient body being supported throughout all angles of rotation.

FIG. 6 illustrates positioning of the patient body 1 on a support surface, such as a table 30, before rotation begins. The patient body 1 is placed in the sling 25 formed by the two plies 26 and 27, which extend around the patient body 1 on the side opposite the intended rotation direction. Free ends of the plies 26 and 27 are joined together and joined to the pulling links 5 of the pulling system 4 via the gripper 6. By applying pulling force, the patient body 1 can be rotated.

If lateral movement is desired during the prone rotation operation, a patient support 2, such as a sheet, for lateral transfer can be placed on the table under the sling 25.

Figure 8:
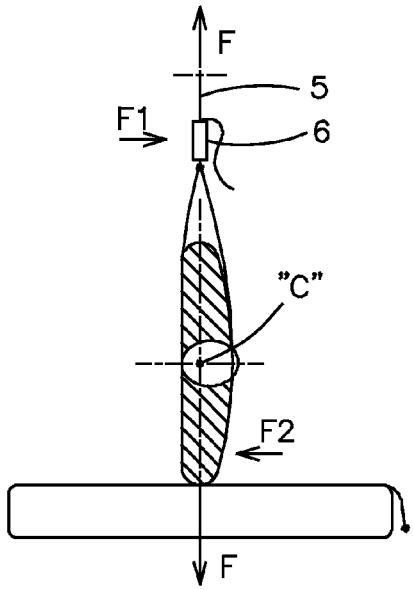
Figure 7:
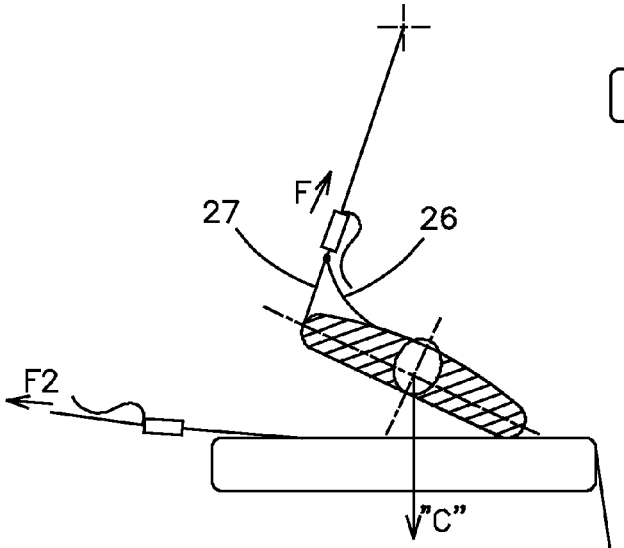
Figure 9:
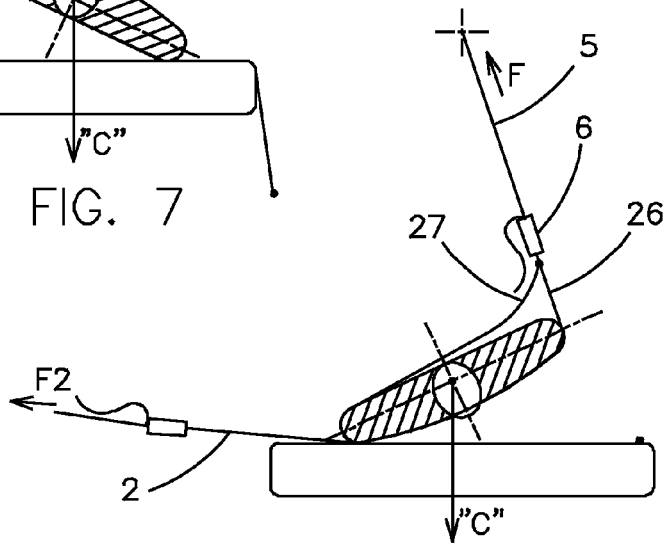

FIGS. 7-9 illustrate the sling 25 operation at different rotation angles.

At a 90 degree angle position (FIG. 8), a pulling force "F" applied to the joint of two plies is in a vertical line with the center gravity "C" of the patient body 1 and two plies 26, 27 equally support the patient body 1.

Changing the position of the center gravity "C" shifts patient weight to one of the ply 26 or 27 and pulling force F is be shifted automatically to the ply 26 or 27 supporting patient in suspended position. The ply 26 or 27 not supporting patient is released from tension.

In FIG. 7, ply 27 supports the patient body 1 and ply 26 is free of tension.

In FIG. 9, ply 26 supports the patient body 1 and ply 27 is free of tension.

FIG. 8 illustrates the prone rotation operation where only one sling is used. Changing center gravity "C" as a result rotation patient can be done by applying force F1 to the gripper 6 engaged with the sing 25 joint or by applying force F2 to the part of the sling 25 contacting the table.

In FIGS. 7 and 9, the prone rotation operation may be performed by using combination of the sling 25 and the sheet 2 for lateral movement support, where rotation is a result of applying a pulling force F to the sling 25 and a sliding force F2 to the sheet 2. The pulling force F must support the patient weight in a suspended or partially suspended position during all angles of rotation. Single or combined movements may be coordinated to provide constant support of the patient's body in any suspended position.

Figure 10:
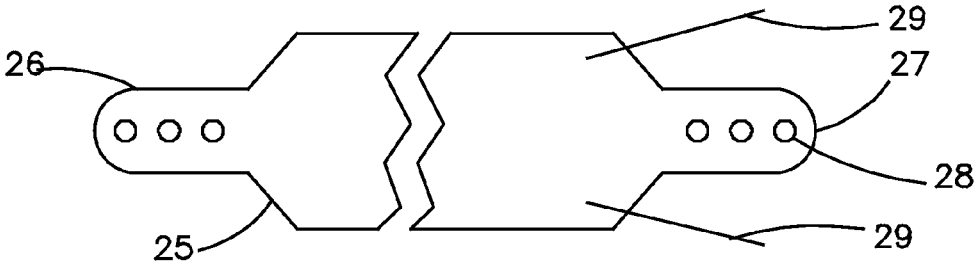
FIG. 10 is an illustration of a sling as a support for patient rotation.

FIGS. 10 and 11 illustrate an embodiment of the sling 25 and an embodiment of the patient support 2 for lateral transfer in prone rotation operation. In other embodiments, the sling 25 and the patient support 2 may take on other forms.

In the prone rotation operation, if lateral repositioning is manual and two caregivers are involved, a simple sheet can be used for the sling 25 and for the patient support 2.

The sling 25 for the prone rotation operation may be a sheet formed by two plies 26 and 27 that extend around the patient body 1 on either side of the patient body 1. The plies 26 and 27 may be joined together and adapted to be attached to the gripper 6. The plies 26, 27 may be differently shaped and may have holes 28 for adjusting a position of engagement with the gripper 6. The sling 25 may have one or more belts 29 permanently or removably attached to the area close to a location of contact by the patient body 1 with the table surface 30 in the 90 degree rotated position. The belts 29 provide simple engagement with the repositioning device and convenience for manual operation.

The sling 25 may include belts around the patient body forming two plies adjustably connected to the gripper 8 on one side of patient body 1. The plies 26, 27, may have adjustably attached buckles for quick connection with the gripper 6. The ply that is free of tension may be disconnected from the griper 6 when the patient body 1 is in a rotated position. For lateral movement, a simple sheet 2 may be used if two operators involved. If one operator performs rotation and the lateral transfer boards 2 of FIG. 11 are used, the lateral transfer boards 2 may include one or more loops 31 and one or more pulling belts 32 that may be attached to sheet. Loops 31 and belts 32 simplify engagement with repositioning device and convenience for manual operation.

The described slings 25 and patient supports 2 are only some of many non-limiting examples of patient supports and one having ordinary skill in the art would be able to design a variety of different models.

FIGS. 12-15 illustrate several examples of patient repositioning systems based on the concepts and components illustrated and described in FIGS. 1-11. The patient repositioning devices illustrated on FIGS. 12-15 are non-limiting examples and one having ordinary skill in the art could modify these devices based on the teachings of this disclosure.

Figure 12:
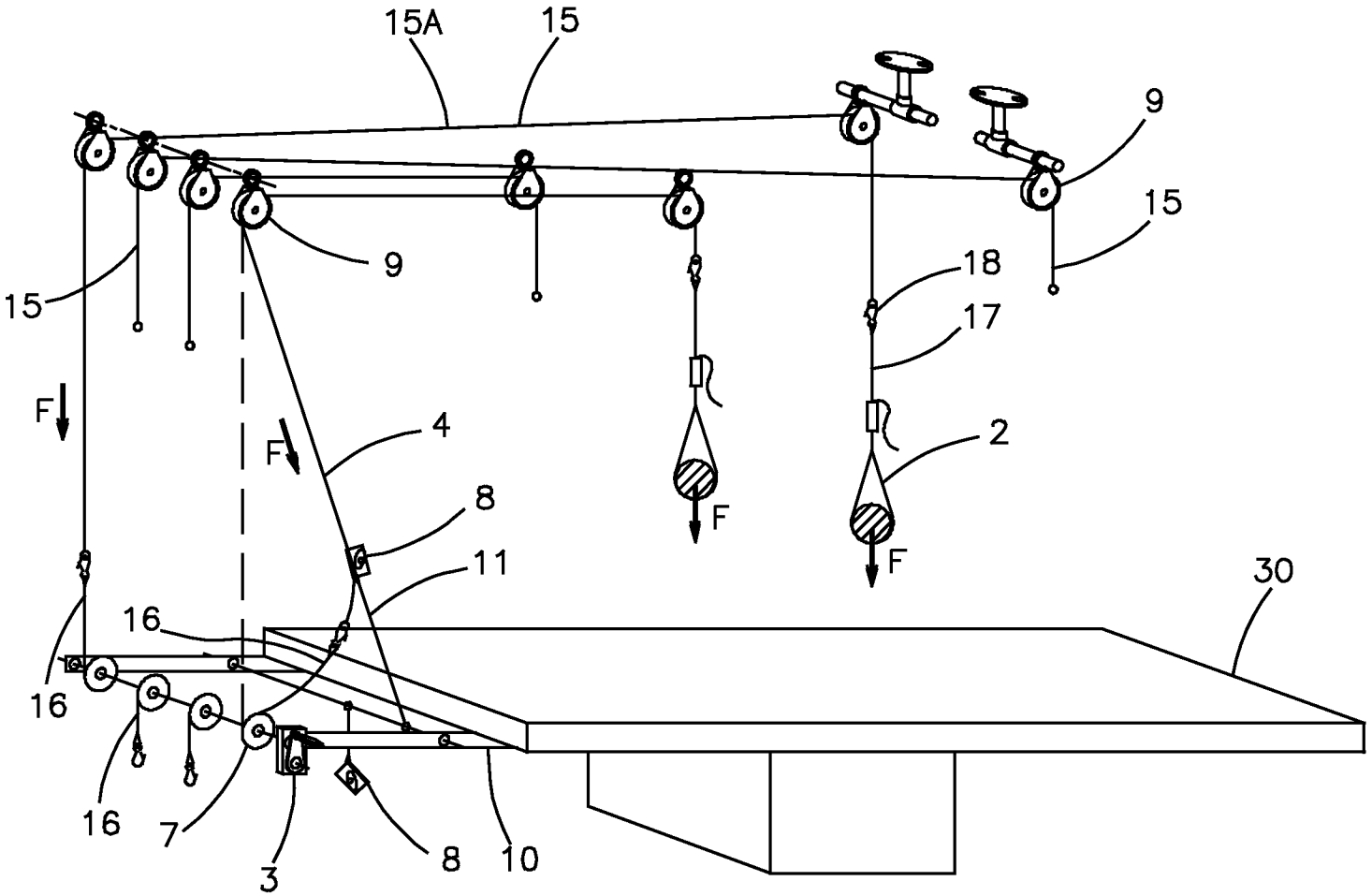
FIG. 12 is an illustration of one embodiment of a stationary repositioning system.

FIG. 12 illustrates one example of a stationary repositioning system where a patient body or limb 1 can be moved and fixed in any sequence of multiple operations. In this embodiment the patient repositioning system includes the drive system 3, one or more guides 9, a plurality of clamps 8, and a plurality of pulling systems 4. The drive system 3 and the clamps 8 may be mounted on the frame 10 and attached to the table 30, where one or more guides 9 may be mounted on the frame 10 above the procedure table 30. The pulling systems 4 may be supported and guided by the guides 9 and operatively attached to the patient support 2 and to the drive system 3. The pulling systems 4 are combinations of the link sections 15, 16 and 17 joined together by connection 18.

Link 15*a* is supported by one guide 9 and is connected to the pulling sections 16 and 17, which are engaged with the drive system 3 and the patient support 2, respectively. Some guides 9 may be mounted on pivoting arms for convenience and flexibility of location for the guides 9. The pulling sections 15, 16 or 17 may have different link shapes and be may be made of different materials, for example, the cable in section 15, the belt in section 16, and the chain in section 17. Such link combinations result in great flexibility in system design.

Ends of the pulling links 15*a*, 16*a*, 17*a*, may be marked to simplify connection to the respective pulling sections 15, 16, 17. Pulling sections 16 and 17 if not involved in operating process may be disconnected from the pulling section 15 so as to not interfere with medical operations being performed around the table 30. Operative engagement of components with the pulling links 15*a*, 16*a*, 17*a*, allows equalization of lengths of two or more pulling systems simultaneously that are involved in patient transfer.

Returning briefly to FIG. 5, a section of the drive 20 may include a linear drive and the pulling sections 15, 16 and 17 may have different constructions. As was described above, the pulling systems 5 can be pre-connected to the patient support 2 to speed up multifunctional operation.

Figure 13:
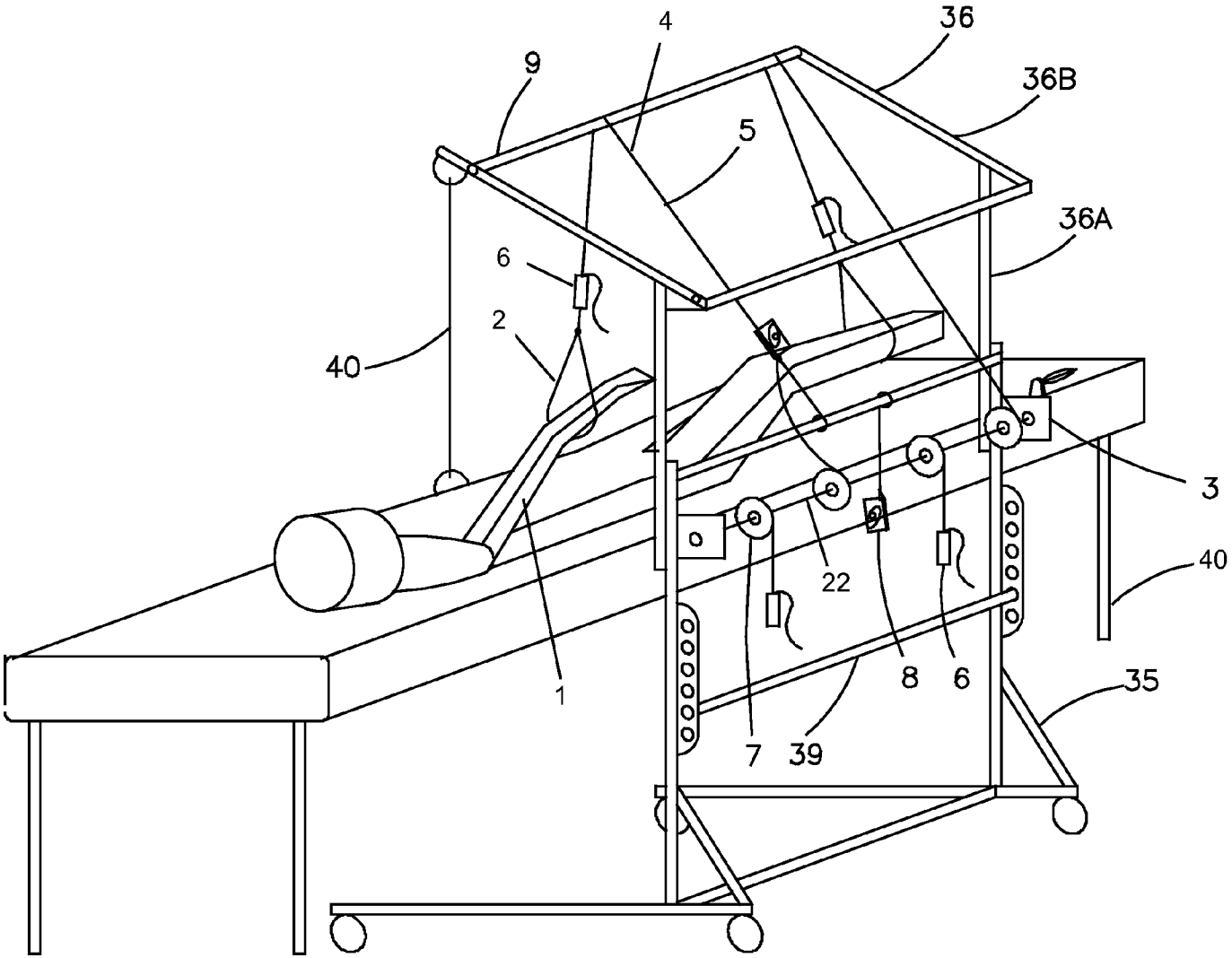
FIG. 13 is a perspective view of one embodiment of a mobile repositioning system with a trapeze attachment and being used to move and fix a patient body or limb in any sequence of multiple operations with a single drive.

FIG. 13 illustrates one embodiment of a mobile repositioning system where a patient body or limb 1 can be moved and fixed in any sequence of multiple operations. Mobile repositioning systems, such as the mobile repositioning system of FIG. 13, have similar designs and operations as those described in the embodiments of FIGS. 1-11, which were mounted on mobile or stationary frames.

The mobile repositioning system includes a drive system 3, one or more guiding elements 9 and 39, one or more clamps 8; and one or more pulling systems 4 assembled on a mobile frame 35. The guiding elements 9 above the patient body may be part of a trapeze 36 attached to the mobile frame 35. The trapeze 36 may be removable or permanently attached to the mobile frame 35. Part of the trapeze 36 may extend above the patient in which extensions 36*a* can be folded with part of the trapeze 36*b* attached to the frame 35.

To reinforce the trapeze 36 and for increased stability of the mobile unit when heavy lifting or rotation required an extra support 40 may be used. One end of the support 40 may be removably attached to an extended part of the trapeze 36 and second end of the extra support 40 may be resting on the floor and removably attached to the base of the mobile unit 35. In other embodiments, the support 40 may be attached to the trapeze 36 and/or to the procedure table 30. The support 40 may be one piece, or the support 40 may be foldable or telescopic with varieties of end connections.

The pulling links 5 may be supported and directed by guiding elements 9 of the trapeze attachment 36, and may be operatively attached to the patient support 2 via gripper 6 and to the shaft 22 of the drive 3 via coupling 7. The coupling 7, the clamp 8, and pulling system 4 may be attached or removed from the mobile frame 35.

A minimum number of the clamps 8 and/or the couplings 7 may be equal to the number of parts of the patient body 1 that will be suspended simultaneously.

FIGS. 14-17 illustrate one embodiment of a prone rotation operation using a mobile patient repositioning system.

Figure 14:
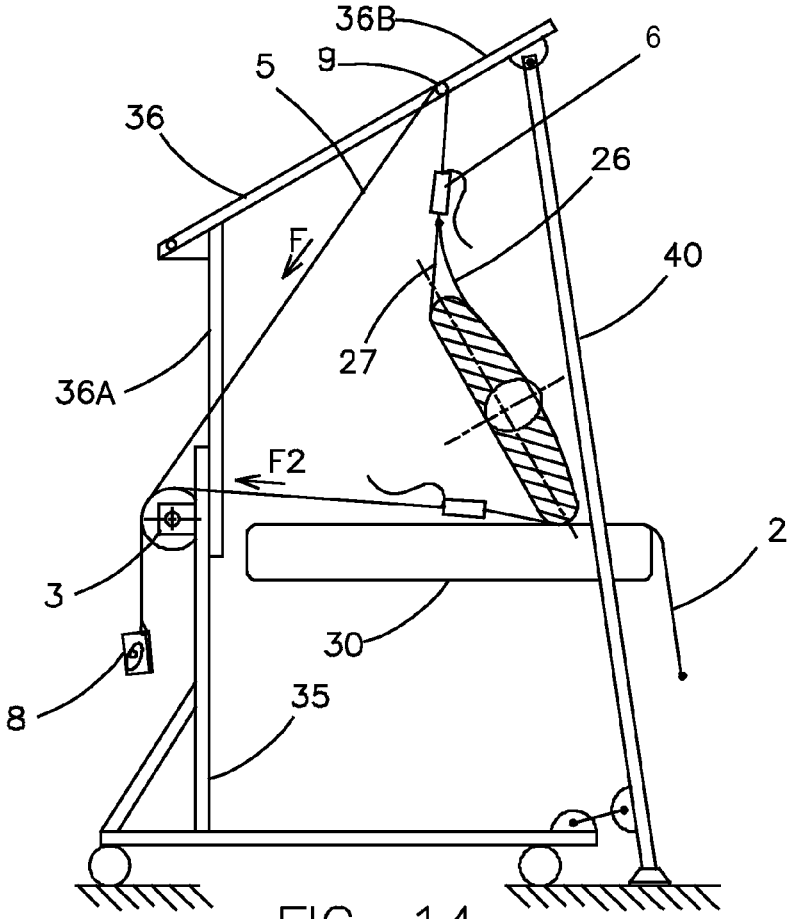
FIG. 14 is an illustration of a prone rotation operation performed with single mobile patient repositioning system.

FIG. 14 illustrates a prone rotation operation on the table 30 using the mobile patient repositioning device with the trapeze attachment 36 of FIG. 13. In this operation, lateral and rotation movements are combined to rotate and position the patient body 1 on a single support surface, such as the table 30.

Initially, the patient support 2 for lateral transfer is placed on the table 30. The belts 32 (FIG. 11) are engaged with the coupling 7 (FIG. 13). The sling 25 is positioned on the patient support 2 and the patient body 1 is placed within the sling 25. The plies 26, 27 of the sling 25 join together on one side of the patient body 1 and are connected to the gripper 6. Rotation and lateral repositioning can be performed in any combination of coordinated angular and lateral movements. The gripper 6 is engaged with the sling 25 must always be under tension supporting patient weight in suspended position. The clamp 8 may be used to fix patient in an intermediate rotated position before lateral repositioning. If more than one operator is involved in the prone rotation operation a simple sheet may be used as the patient support 2 for lateral movement.

Figure 15:
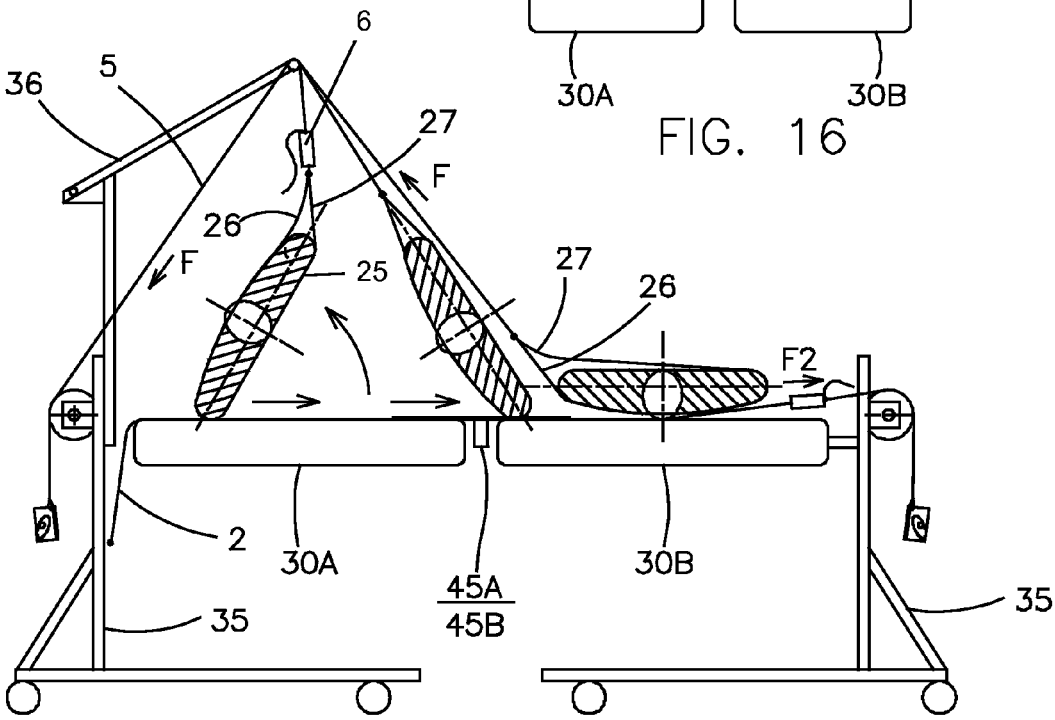
FIG. 15 is an illustration of the prone rotation and repositioning operation performed with two mobile patient repositioning systems.

FIG. 15 illustrates the prone rotation operation and lateral transfer of the patent body 1 from a first table 30*a* to a second table 30*b*. In this operation two mobile repositioning systems are used, a first mobile repositioning system including the trapeze attachment 36 for rotation and a second mobile repositioning system without a trapeze attachment for lateral movement. Rotation and lateral repositioning may be performed in any combination of coordinated angular and lateral movements. The gripper 6 is engaged with the sling 25 must always be under tension F supporting weight of the patient body 1 in suspended or partially suspended position.

There are unlimited combinations to design varieties of stationary or mobile repositioning systems to perform multifunctional repositioning and prone rotation operations with the patient repositioning systems described herein.

Figure 17:
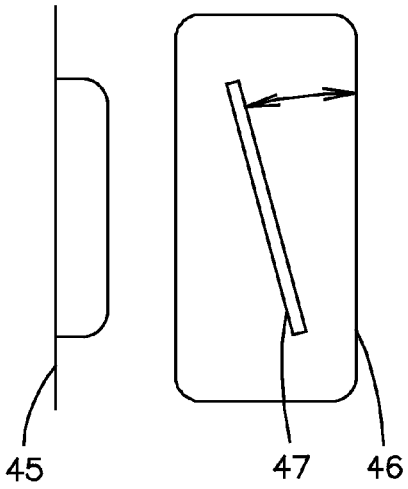
FIG. 17 is an illustration of a construction of the boards.
Figure 16:
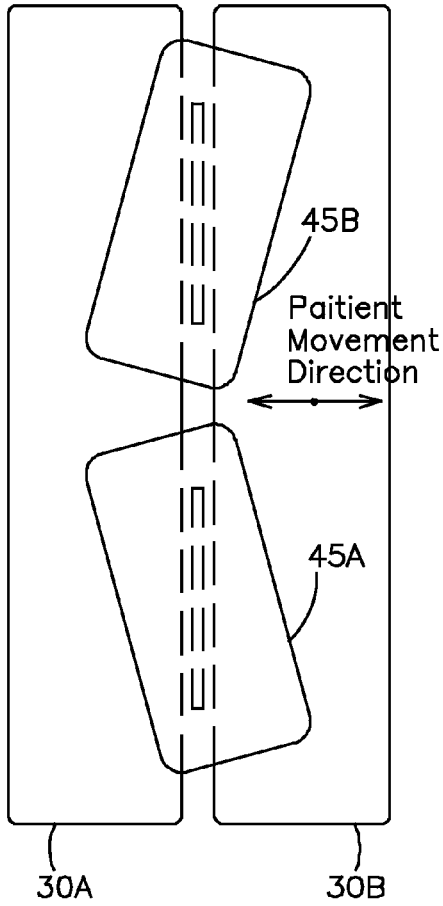
FIG. 16 is a top view of a pair of boards that are used in the multifunctional repositioning of FIG. 15.

FIGS. 15-17 are illustrate the prone rotation and lateral repositioning operation using two transfer boards 45*a* and 45*b* located between the two tables 30*a* and 30*b* Each transfer board 45*a* and 45*b* includes a plate 46 and a rib 47. The rib 47 may be positioned at an angle with respect to a longitudinal axis of the plate 46 to create an angle between the transfer boards 45*a* and 45*b* directed towards movement of the patient body 1. The transfer boards 45*a* and 45*b* with the angularly positioned ribs 47 create an easier patient transfer (by vertically compressing only one end of the transfer boards 45*a*, 45*b* at a time).

The patient repositioning system's ability to move and fix a patient body or a limb in a suspended position allows movement of the patient body or limb to a specific angle or to a specific distance in repeatable motions if the patient bed 30 has vertical movement.

Figure 18:
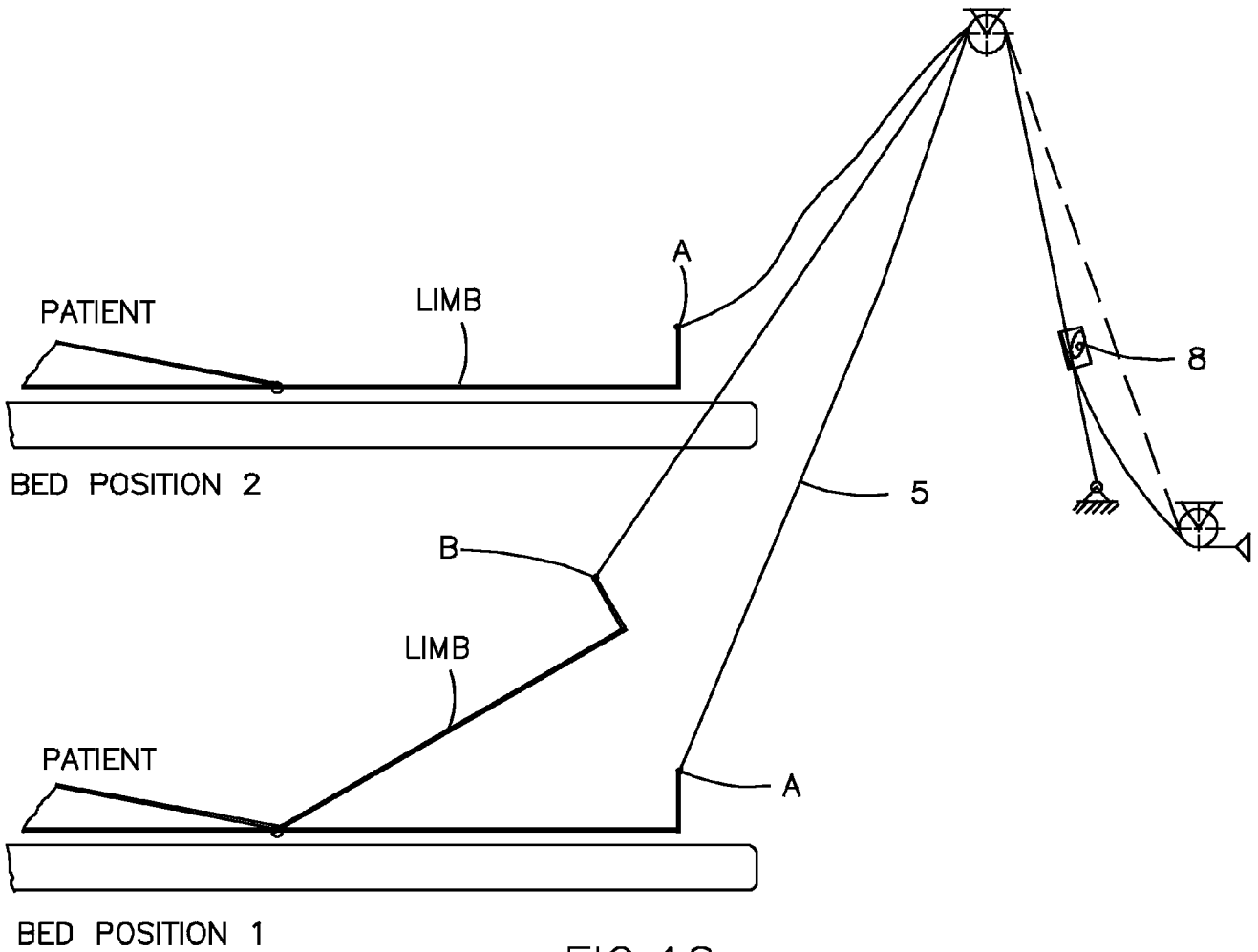
FIG. 18 is a schematic illustration of a repeatable repositioning patient body or limb.

As illustrated in FIG. 18, initially the patient is resting on the bed 30, which is in its lowest vertical position 101. The patient repositioning system is used to move and fix the patient limb 1 from a resting position "A" to a specified suspended position "B," which can be defined angularly (e.g., 10 degrees) or by distance (e.g., raised 10 cm). Vertical up and down bed movements from its low position 101 to a maximum upper position 102 will move the patient from the resting position "A" to the initial suspended set up position "B." Any vertical bed positions will move the patient equal or less than the initial set up position, which may be important for patient safety. If the bed 30 has a powered vertical drive and can be operated by via remote control, the patient may perform repeatable motions without caregiver assistance.

The invention was described in concepts, methods and examples of some system embodiments. Those having ordinary skill in the art may modify the disclosed devices and systems without departing from the scope of the claims.

The invention claimed is:

1. A patient repositioning system to move and fix a patient body and/or a limb in any sequence of multiple operations with positive body or limb support at any angle of rotation or repositioning, the system comprising:

a frame;

a drive system attached to the frame;

a first pulling system operatively connected to the drive system by a first coupling and removably connected to a patient support by a gripper;

a clamping system operatively connected to the first pulling system and removably connected to the frame; and a guiding system removably attached to the frame, the guiding system being adapted to direct and support the pulling system, wherein multiple pulling systems, clamping systems, and guiding systems may be added or removed to optimize performance of the system, wherein engaging the first coupling and the first pulling system with the drive system and activating the drive system pulls the first pulling system and moves the patient or limb from a first position to a second position, and when the clamp is temporarily connected to the pulling system, the clamp supports the patient body or limb in a suspended position, simultaneously releasing tension from the first coupling and from the drive system, which allows the first coupling to disconnect the first pulling system from the drive system, and the free of tension drive system may be engaged by another coupling with other pulling systems in any sequence or combination for a subsequent patient movement, while the clamping system supports the weight of the patient body or limb on the first pulling system, thereby maintaining the position of the first pulling system during subsequent patient movements, and a guiding element that is part of a trapeze attachment is located above the patient body, the trapeze attachment being removably attached to the frame.

2. The patient repositioning system of claim 1, wherein the drive system includes a drive connected to a drive connecting system.

3. The patient repositioning system of claim 1, further comprising a drive as a source of power and a drive connecting system to removably and operatively connect the first coupling to the drive system.

4. The patient repositioning system of claim 1, wherein multiple couplings can be operatively connected to the drive connecting system in any sequence or combination.

5. The patient repositioning system of claim 1, wherein the pulling system includes a single pulling link that is operatively and removably connected to the gripper and to the coupling.

6. The patient repositioning system of claim 1, wherein the pulling system includes a plurality of operatively and removably connected pulling link sections.

7. The patient repositioning system of claim 1, wherein the coupling, the clamp and the pulling system are removable from the patient repositioning system.

8. The patient repositioning system of claim 1, wherein the trapeze attachment has an additional support that is removably connected to the frame.

9. The patient repositioning system of claim 8, wherein the additional support is removably attached to the trapeze and to a base of the frame.

10. A patient repositioning system to move and fix a patient body and/or a limb in any sequence of multiple operations with positive body or limb support at any angle of rotation or repositioning, the system comprising:

a frame;

a drive system attached to the frame;

a first pulling system operatively connected to the drive system by a first coupling and removably connected to a patient support by a gripper;

a clamping system operatively connected to the first pulling system and removably connected to the frame; and a guiding system removably attached to the frame, the guiding system being adapted to direct and support the pulling system, wherein multiple pulling systems, clamping systems, and guiding systems may be added or removed to optimize performance of the system, wherein engaging the first coupling and the first pulling system with the drive system and activating the drive system pulls the first pulling system and moves the patient or limb from a first position to a second position, and when the clamp is temporarily connected to the pulling system, the clamp supports the patient body or limb in a suspended position, simultaneously releasing tension from the first coupling and from the drive system, which allows the first coupling to disconnect the first pulling system from the drive system, and the free of tension drive system may be engaged by another coupling with other pulling systems in any sequence or combination for a subsequent patient movement, while the clamping system supports the weight of the patient body or limb on the first pulling system, thereby maintaining the position of the first pulling system during subsequent patient movements, and further including two transfer boards for moving a patient body over a gap between transfer surfaces, each of the two transfer boards having at least one angularly positioned rib, the angularly positioned ribs being non-parallel and non-perpendicular to any of the sides of the boards.

11. The patient repositioning system of claim 10, wherein one transfer board is positioned to mirror the other transfer board.

12. The patient repositioning system of claim 1, wherein the patient support takes the form of a sling that includes a first ply and a second ply joined to one another along a side of a patient body opposite to an intended direction of rotation and wherein the gripper is removably attached to joint of the first ply and the second ply.

13. The patient repositioning system of claim 12, wherein a joint position of the plies is adjustable.

14. The patient repositioning system of claim 12, wherein a free of tension ply is disconnectable from the gripper.

15. The patient repositioning system of claim 12, wherein the patient support includes another sheet for lateral movement.

16. The patient repositioning system of claim 1, wherein the drive system further comprises a locking mechanism to lock the drive system in position before engagement of the clamp.

17. The patient repositioning system of claim 1, wherein at least one coupling is fixed to the drive system.

* * * * *

UNITED STATES PATENT AND TRADEMARK OFFICE

CERTIFICATE OF CORRECTION

PATENT NO. : 8,726,431 B2
APPLICATION NO. : 13/534659
DATED : May 20, 2014
INVENTOR(S) : Sverdlik et al.

It is certified that error appears in the above-identified patent and that said Letters Patent is hereby corrected as shown below:

Title Page:

Item (76), Line 1, "Bufflao Grove," should be -- Buffalo Grove, --.

Signed and Sealed this
Eighteenth Day of August, 2015

Michelle K. Lee

Michelle K. Lee
*Director of the United States Patent and Trademark Office*